US007434855B2

(12) United States Patent
Maeda

(10) Patent No.: US 7,434,855 B2
(45) Date of Patent: Oct. 14, 2008

(54) STAY STRUCTURE

(75) Inventor: Hiroshi Maeda, Yokohama (JP)

(73) Assignee: Piolax Inc., Kanagawa-ken (JP)

( * ) Notice: Subject to any disclaimer, the term of this patent is extended or adjusted under 35 U.S.C. 154(b) by 0 days.

(21) Appl. No.: 11/483,534

(22) Filed: Jul. 11, 2006

(65) Prior Publication Data

US 2007/0029821 A1 Feb. 8, 2007

(30) Foreign Application Priority Data

Jul. 19, 2005 (JP) ..... 2005-208213

(51) Int. Cl.
*E05C 17/44* (2006.01)
*E05F 5/02* (2006.01)

(52) U.S. Cl. ..... 292/338; 292/262; 292/DIG. 15; 16/82

(58) Field of Classification Search ..... 292/338, 292/339, 202, 262, DIG. 15, DIG. 38, 388; 16/82, 83; 403/56, 76, 122, 133, 135, 141, 403/143

See application file for complete search history.

(56) References Cited

U.S. PATENT DOCUMENTS 1,606,084 A * 11/1926 Kline ..... 292/338
1,799,265 A * 4/1931 Unkelbach et al. ..... 292/272
4,676,022 A * 6/1987 Wraight ..... 43/121
4,684,279 A * 8/1987 Weber ..... 403/136
5,273,326 A * 12/1993 Kinkaide ..... 292/272
6,942,256 B2 * 9/2005 Amy ..... 292/100

* cited by examiner

*Primary Examiner*—Carlos Lugo
(74) *Attorney, Agent, or Firm*—Westerman, Hattori, Daniels & Adrian, LLP.

(57) ABSTRACT

A stay structure includes a stay main body having a ball-like portion at one end, and a base member configured to hold the ball-like portion. The base member includes a first base portion and a second base portion detachably attached to first base portion. The first base portion is provided with an upwardly protruded peripheral wall portion. The peripheral wall portion is divided into a plurality of divided wall pieces, and is provided with a recessed groove portion capable of holding an external periphery of the stay main body. The second base portion is provided with a pedestal portion fitted to the peripheral wall portion. The pedestal portion has at its upper surface a recessed curved surface on which the ball-like portion is swingably disposed. The ball-like portion is swingably held by and between the inner surface of the peripheral wall portion and the curved surface of the pedestal portion.

15 Claims, 10 Drawing Sheets

STAY STRUCTURE

This application claims priority under 35 U.S.C. §119 to Japanese Patent Application No. 2005-208213 filed on Jul. 19, 2005, the entire disclosure of which is incorporated herein by reference in its entirety.

BACKGROUND OF THE INVENTION

1. Field of the Invention

The present invention relates to a stay structure and some embodiments relate to a stay structure for maintaining an opened state of a cover or a lid for closing/opening an opening of a storage box provided under a floor of a rear luggage area of a vehicle such as an automobile.

2. Description of Related Art

The following description sets forth the inventor's knowledge of known art and problems therein and should not be construed as an admission of knowledge in the prior art.

A storage box for storing, e.g., a spare tire and/or tools is often provided, under a floor of a rear luggage area of a vehicle, e.g., an automobile. At the floor of the rear luggage area having an opening for the storage box, a cover (a cover board) for opening/dosing the opening is attached. The cover board is configured such that when the cover board is opened, the opening state can be maintained by being supported with a stay or a supporting member (hereinafter referred to as "stay".)

In general, a main body of the stay ("stay main body") is mounted to a vehicle in a state in which the basal end of the stay main body is pivotally supported near the opening peripheral edge portion of the storage box formed in the luggage floor. When the cover board is opened, the opened state thereof can be maintained by raising the stay main body and then supporting the cover board with the top end of the stay main body.

However, in the structure in which the stay main body is mounted to the luggage floor side, mounting space is provided for the stay main body, e.g., at the vicinity of the opening peripheral edge portion of the storage box. One problem with this is that the opening area of the storage box is reduced.

In overcome this problem, Japanese Unexamined Laid-open Utility Model Publication No. H03-120243 proposes a technique in which a stay main body is mounted on a rear side of a cover board. For example, the stay main body is pivotally mounted on a cover board with the stay main body stored in a groove formed in the periphery of the cover board. When the cover board is opened, a user takes out the stay main body from the groove by pivotally moving the stay main body and puts the top end thereof on the luggage floor to maintain the opened state of the cover board.

In this case, as disclosed by Japanese Utility Model Registration No. 2606644, if a ball-like portion (pivot) is formed at one end of a stay main body and a base member (retainer) having a peripheral wall portion for swingably supporting the ball-like portion (pivot) is attached to a cover board, the stay main body can freely swing about the ball-like portion so as to draw a conical shape, which can enlarge the stay supporting position range on the luggage floor.

As disclosed by the Japanese Utility Model Registration No. 2606644, in cases where the base member for holding the ball-like portion formed at one end of the stay main body is attached to the cover board, the swing inclination angle of the stay main body about the ball-like portion is greatest when the neck portion of the ball-like portion comes into contact with the upper end of the peripheral wall portion of the base member. Accordingly, if the stay main body is forced to be inclined beyond the maximum swing inclination angle, the ball-like portion is pulled out of the peripheral wall portion as the neck portion of the ball-like portion becomes a fulcrum.

In this technique, an inwardly bent portion is formed at the upper end portion of the peripheral wall portion so that the ball-like portion is held in the peripheral wall portion with the lower end of the inwardly bent portion engaged with the neck portion of the ball-like portion. With this structure, the ball-like portion is forcibly fitted within the peripheral wall portion from the inwardly bent portion side. In order to enhance the holding state of the ball-like portion within the peripheral wall portion, it can be considered to increase the holding force by the inwardly bent portion. However, assembly requires forcibly pressing the ball-like portion into the peripheral wall portion with abnormal force, resulting in reduced assembling efficiency. On the other hand, if the holding force by the inwardly bent portion is decreased for the purpose of enhancing the assembling efficiency, the ball-like portion will be easily detached.

Furthermore, at the time of the detachment of the ball-like portion from the peripheral wall portion, the inwardly bent portion can break or be permanently deformed. If this happens, then, the ball-like portion cannot be returned to the inside of the peripheral wall portion.

The description herein of advantages and disadvantages of various features, embodiments, methods, and apparatus disclosed in other publications is in no way intended to limit the present invention. Indeed, certain features of the invention may be capable of overcoming certain disadvantages, while still retaining some or all of the features, embodiments, methods, and apparatus disclosed therein.

SUMMARY OF THE INVENTION

The preferred embodiments of the present invention have been developed in view of the above-mentioned and/or other problems in the related art. The preferred embodiments of the present invention can significantly improve upon existing methods and/or apparatuses.

Among potential advantages, some embodiments provide a stay structure capable of easily attaching a ball-like portion formed at an end of a stay main body to a peripheral wall portion of a base member without requiring excessive force.

Among potential advantages, some embodiments provide a stay structure in which the ball-like portion is difficult to be detached from the peripheral wall portion.

Among potential advantages, some embodiments provide a stay structure capable of easily re-attaching the ball-like portion of the stay main body to the peripheral wall portion of the base member without causing any deformation or damage of the peripheral portion even after the detachment of the ball-like portion from the peripheral wall portion.

According to one aspect of the present invention, a stay structure comprises a stay main body having a ball-like portion at one end of the stay main body and a base member configured to hold the ball-like portion. The base member includes a first base portion and a second base portion detachably attached to the first base portion wherein the first base portion is provided with a hole and a peripheral wall portion upwardly protruded from a periphery of the hole, the peripheral wall portion having an inner surface narrowed at an upper portion thereof. The peripheral wall portion is divided by vertically extended slits into a plurality of divided wall pieces, at least one of the slits being provided with a recessed groove portion capable of holding an external periphery of the stay main body. The second base portion is provided with a flange portion in contact with a rear surface of the first base portion and a pedestal portion protruded toward the first base portion from the flange portion and fitted in the peripheral wall portion. The pedestal portion has at its upper surface a curved surface on which the ball-like portion is swingably disposed and the ball-like portion is swingably held by the inner surface of the peripheral wall portion and the curved surface of the pedestal portion.

With this structure, the base member for holding the ball-like portion formed at one end of the stay main body is constituted by the first base portion and the second base portion, and the second base portion is configured to be attached to the first base portion from the rear surface side thereof. Therefore the ball-like portion of the stay main body can be easily mounted to the first base portion from the rear surface side without requiring large force before mounting the second base portion to the first base portion, resulting in improved workability. Also, even in the case of a detachment of the ball-like portion, the ball-like portion can be easily remounted.

Therefore, it is not required to unnecessarily decrease the rigidity of the divided wall pieces formed by dividing the peripheral wall portion via slits in view of the assembly of the ball-like portion. As a result, even in the case of the detachment of the ball-like portion due to excessive force applied to the stay main body, the peripheral wall portion will not be permanently deformed or broken.

It is preferable that the first base portion is further provided with an elastic engaging piece downwardly extending from a lower portion of the inner surface of the peripheral wall portion so as not to protrude from the rear surface of the first base portion and a gap formed behind the elastic engaging piece, wherein the second base portion is provided with an engaging portion to be engaged with the elastic engaging piece, the engaging portion being formed on an external periphery of the pedestal portion, wherein the flange portion of the second base portion is in contact with the rear surface of the first base portion and the engaging portion is engaged with the elastic engaging piece.

In this case, the first base portion can be fixed to the second base portion by engaging the elastic engaging piece of the first base portion with the engaging portion of the second base portion. Since the elastic engaging piece is formed so as not to protrude from the rear surface of the first base portion, the engaging piece should not break by contact during assembly. Moreover, the height of the first and second base portions after the assembly can be minimized, which increases the storage capacity of a cover to which the stay is attached.

It is preferable that the elastic engaging piece is formed at a position different from a position of the slit in which the recessed groove portion is formed. This makes it possible to form the recessed groove portion relatively deep so as to hold the external periphery of the stay main body at a lower position, which in turn can decrease the height of the base member.

It is preferable that a fastening hole is formed in at least one of the first base portion and the second base portion, and the fastening hole is formed at a position where an extending direction of the stay main body held by the recessed groove portion does not cross. Thus, even if a screw head protrudes from the fastening hole, the screw head does not interfere with the stay main body. Accordingly, the recessed groove portion can be formed relatively deep, which makes it possible to lower the height of the base member.

It is preferable that the base member is fixed to a cover with a fastening member via the fastening hole. Therefore, when the base member is fixed to the cover side, it is not necessary to provide a space for accommodating the stay at a storage box side, and a user can easily recognize the stay when the cover is opened.

It is preferable that the first base portion is provided with a recessed portion formed on the rear surface thereof and the flange portion of the second base portion is fitted in the recessed portion. In this case, the height of the stay member can be reduced.

It is preferable that the second base portion is provided with a protrusion formed on an external periphery thereof, the first base portion is provided with a concave portion formed on an internal periphery thereof, and the flange portion of the second base portion is fitted in the recessed portion of the first base portion with the protrusion engaged with the concave portion. Thus, the second base portion is positioned in the rotational direction and the movement thereof in the rotational direction can be restricted.

It is preferable that the first base portion and the second base portion are each made of a resilient material.

The above and/or other aspects, features and/or advantages of various embodiments will be further appreciated in view of the following description in conjunction with the accompanying figures. Various embodiments can include and/or exclude different aspects, features and/or advantages where applicable. In addition, various embodiments can combine one or more aspect or feature of other embodiments where applicable. The descriptions of aspects, features and/or advantages of particular embodiments should not be construed as limiting other embodiments or the claims.

BRIEF DESCRIPTION OF THE DRAWINGS

The preferred embodiments of the present invention are shown by way of example, and not limitation, in the accompanying figures, in which.

DETAILED DESCRIPTION OF THE INVENTION

In the following paragraphs, some preferred embodiments of the invention will be described by way of example and not limitation. It should be understood based on this disclosure that various other modifications can be made by those in the art based on these illustrated embodiments.

Figure 1:
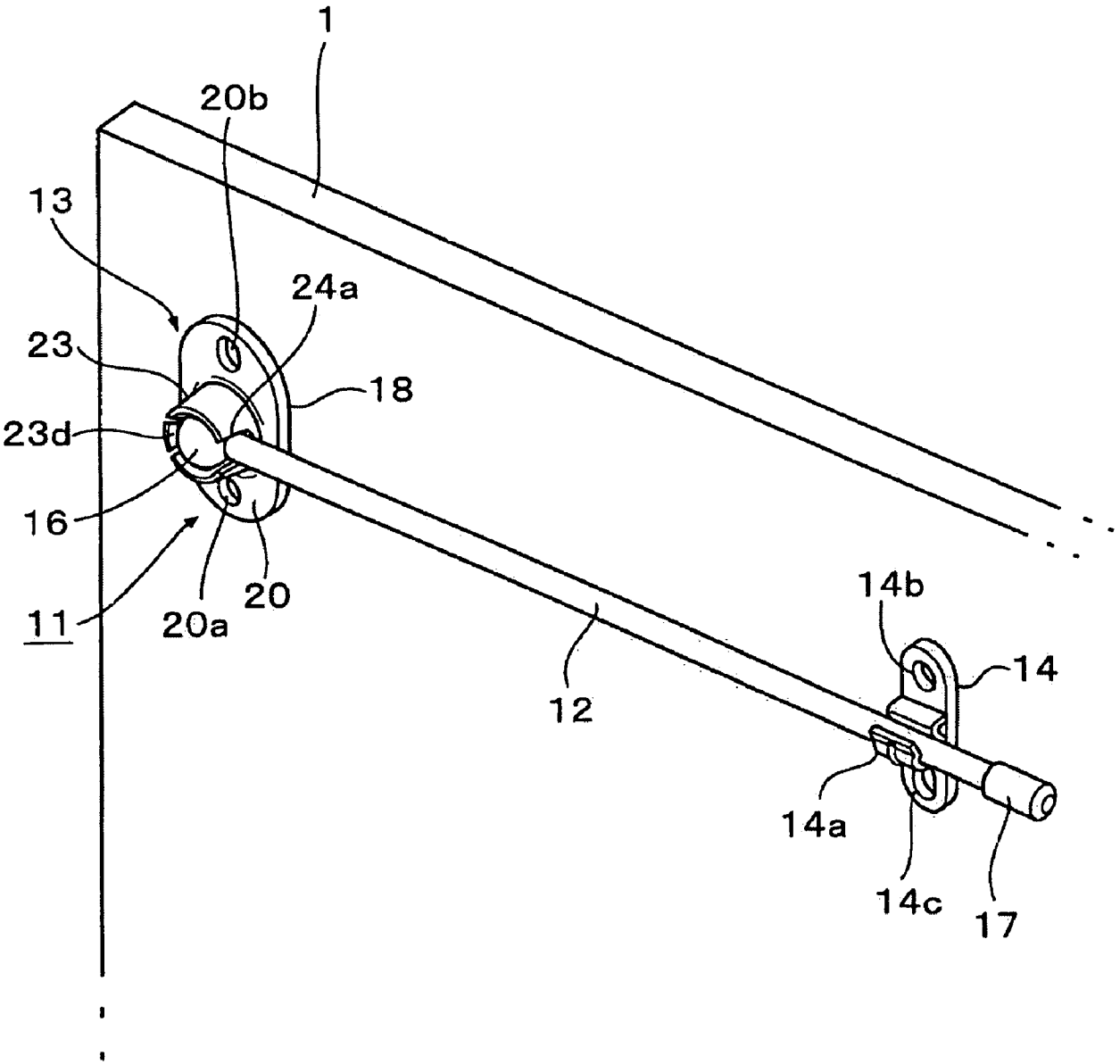
FIG. 1 is a perspective view showing the state in which a stay is attached to a cover.
Figure 2:
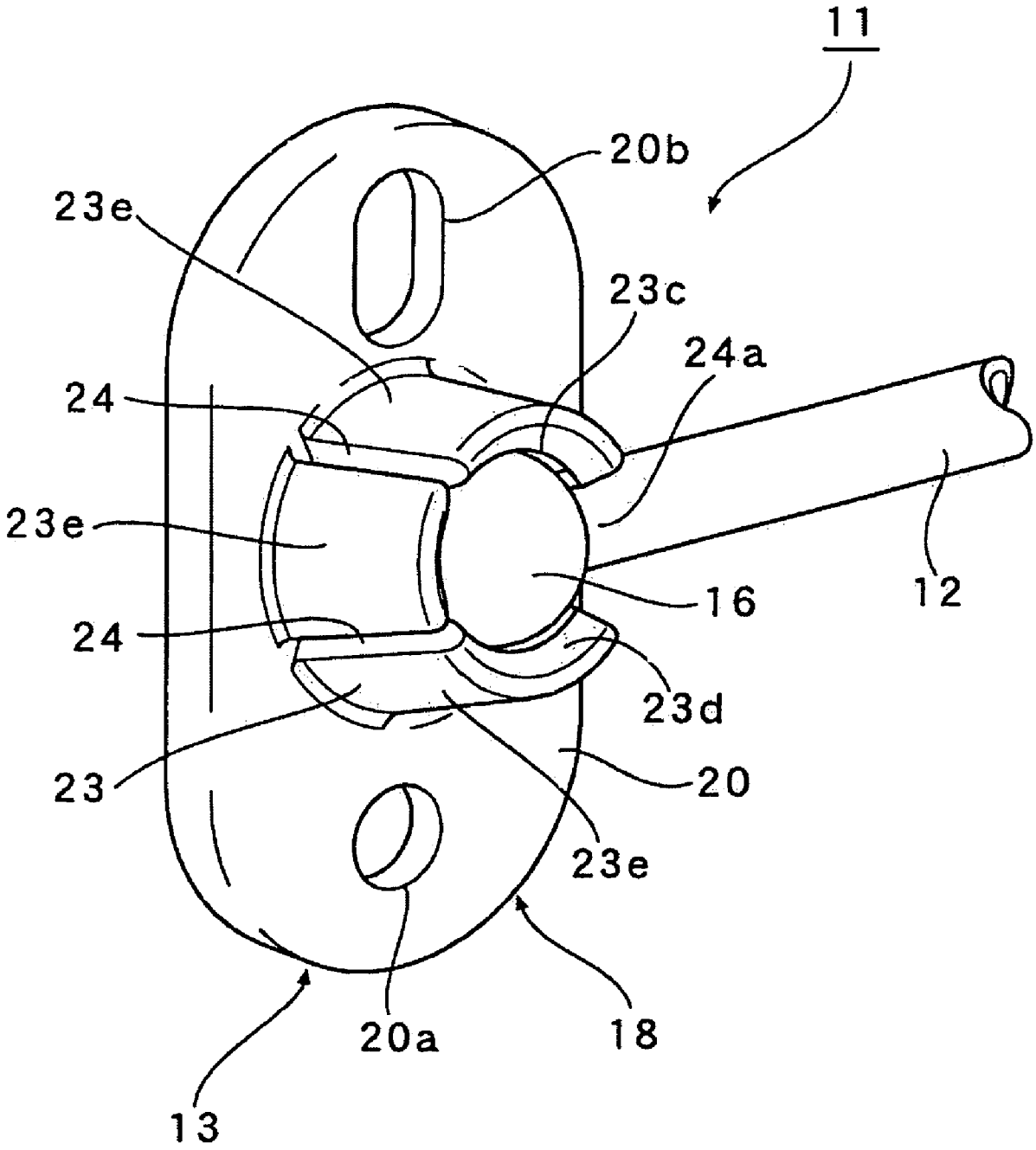
FIG. 2 is an enlarged perspective view showing a principal portion of the stay shown in FIG. 1.

A partial perspective view showing the state in which a stay is attached to a cover member is shown in FIG. 1.

Figure 8:
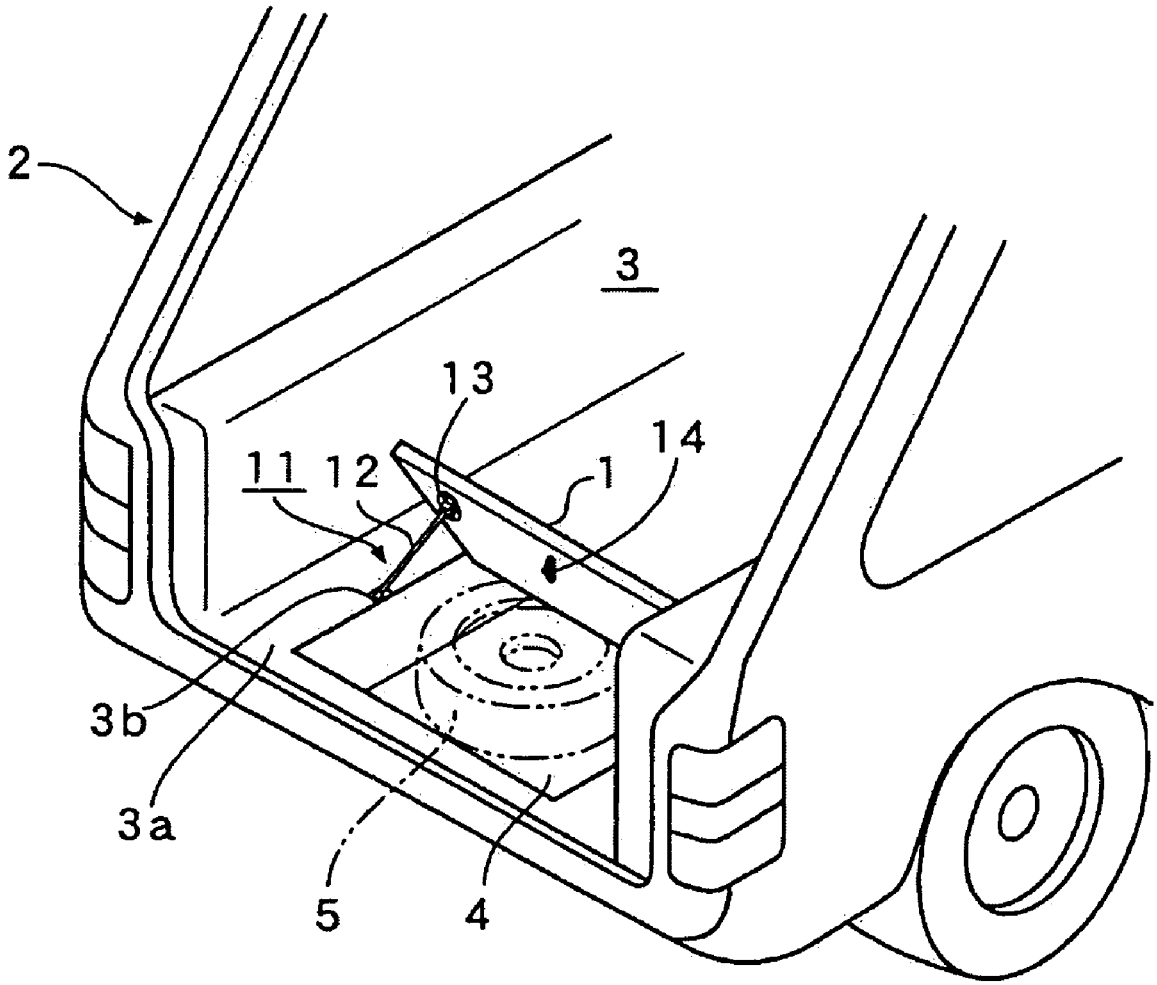
FIG. 8 is a perspective view showing a rear luggage area of an automobile.

The cover member 1 can be used as a cover board for opening/closing an upper opening of a storage box 4 provided under the floor of a rear luggage area 3 of a vehicle 2 such as, e.g., an automobile as shown in FIG. 8. The following explanation is directed to an embodiment in which a stay 11 is attached to a cover board 1 as the cover member.

This storage box 4 is formed so as to accommodate, for example, a spare tire 5. Above the spare tire 5, a tray (not shown) for storing tools is to be disposed. The cover board 1 is provided so as to open/close the storage box 4 with an end portion of the cover board 1 attached to a vehicle front side edge portion of an upper opening of the storage box 4 with a hinge or the like in a pivotable and detachable manner.

The cover board 1 can be opened by lifting up the vehicle rear end side (open end side) of the cover board 1. The open state of the cover board 1 can be maintained by rotating a stay main body 12 of a stay 11 attached to the open end side inner surface of the cover board 1 about the basal end of the stay main body 12 and then engaging the tip end portion of the stay main body 12 with an engaging recessed portion 3*b* formed in the luggage floor 3*a*.

As shown in FIG. 1, the stay 11 is comprised of stay main body 12, base member 13 and fastening member 14. The stay main body 12 is formed by, for example, cutting a metal pipe into a certain length, and has, at its basal end portion, a ball-like portion 16 formed by an insert molding method so as to integrally surround a basal end portion of a generally trapezoidal shape formed by flattening the end portion of the metal pipe. At the top end of the stay main body 12, a cap 17 made of soft material, such as, e.g., rubber, is provided.

Figure 3:
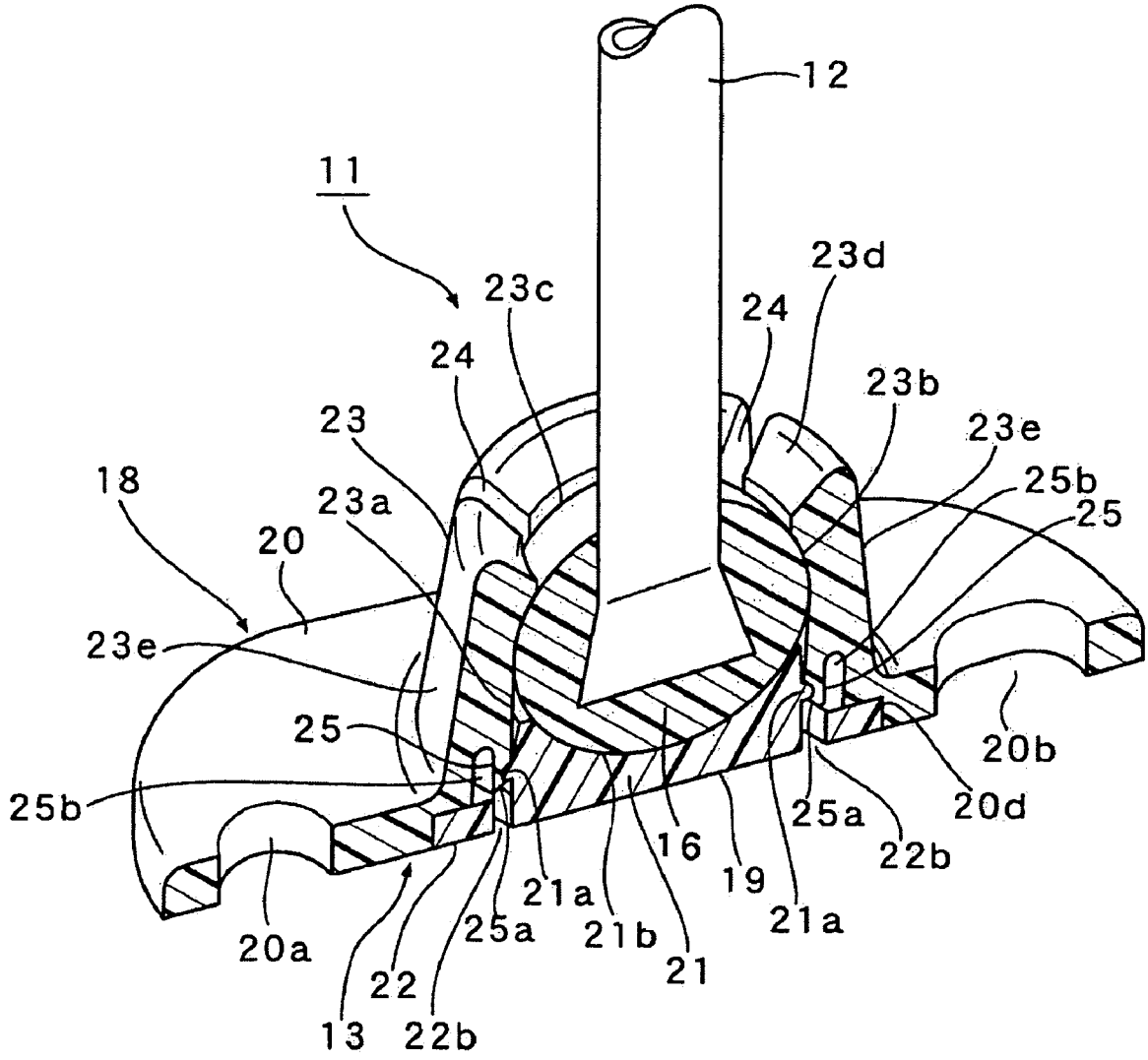
FIG. 3 is an enlarged broken perspective view showing the principal portion of the stay.

As shown in FIG. 3, the base member 13 is comprised of a first base portion 18, and a second base portion 19 attached to the first base portion 18. Both base members 18 and 19 are molded articles made of materials having a certain level of flexibility such as, e.g., resin.

The first base portion 18 has a base portion main body 20 of a substantially oval shape. Each of the longitudinal both end portions of the base portion main body 20 is provided with a round screw hole (fastening hole) 20*a* (20*b*). At the central portion of this base portion main body 20, a round hole 20*c* is formed. At the bottom side of this hole 20*c*, a recessed portion 20*d* is formed concentrically so as to fit a flange portion 22 formed at a lower end of a pedestal portion 21 of the second base portion 19.

Figure 5:
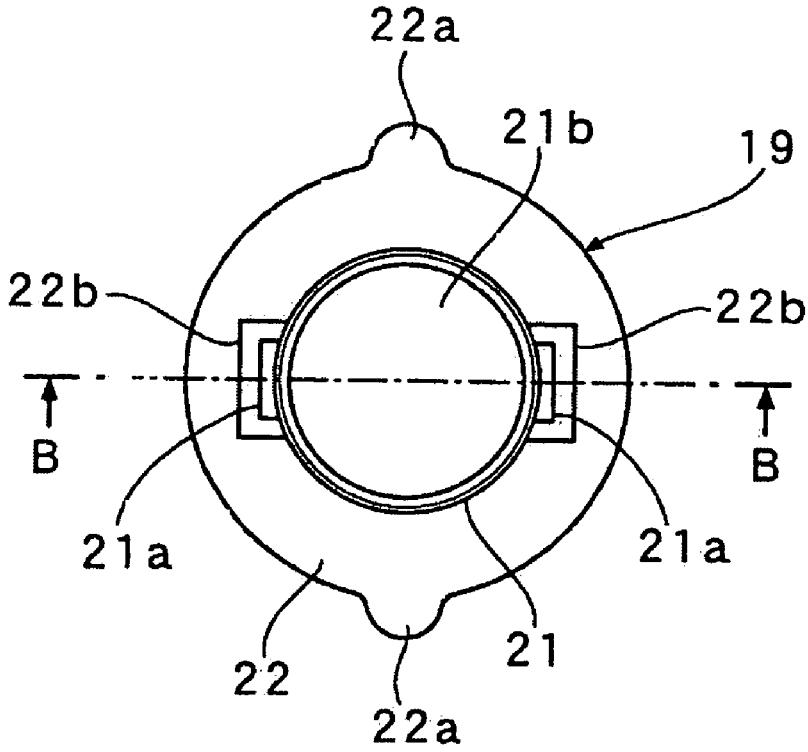
FIG. 5A is a plan view showing a second base portion of the stay.
FIG. 5B is a cross-sectional view taken along the line B-B in FIG. 5A.
Figure 5:
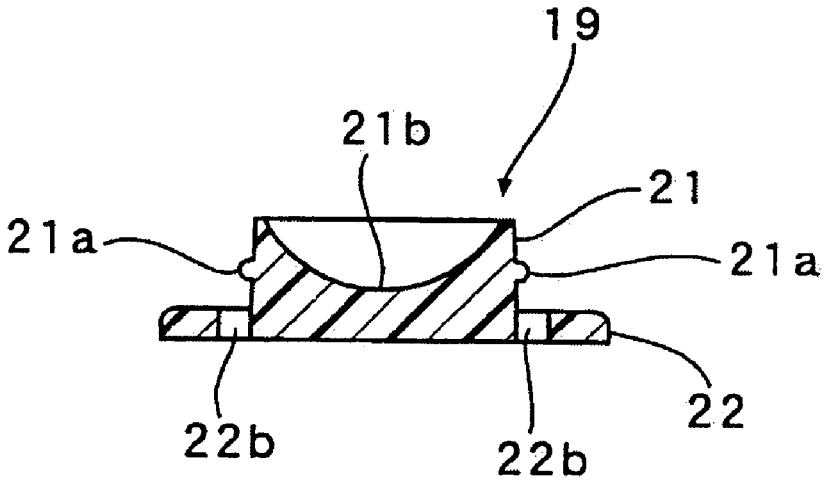
Figure 6:
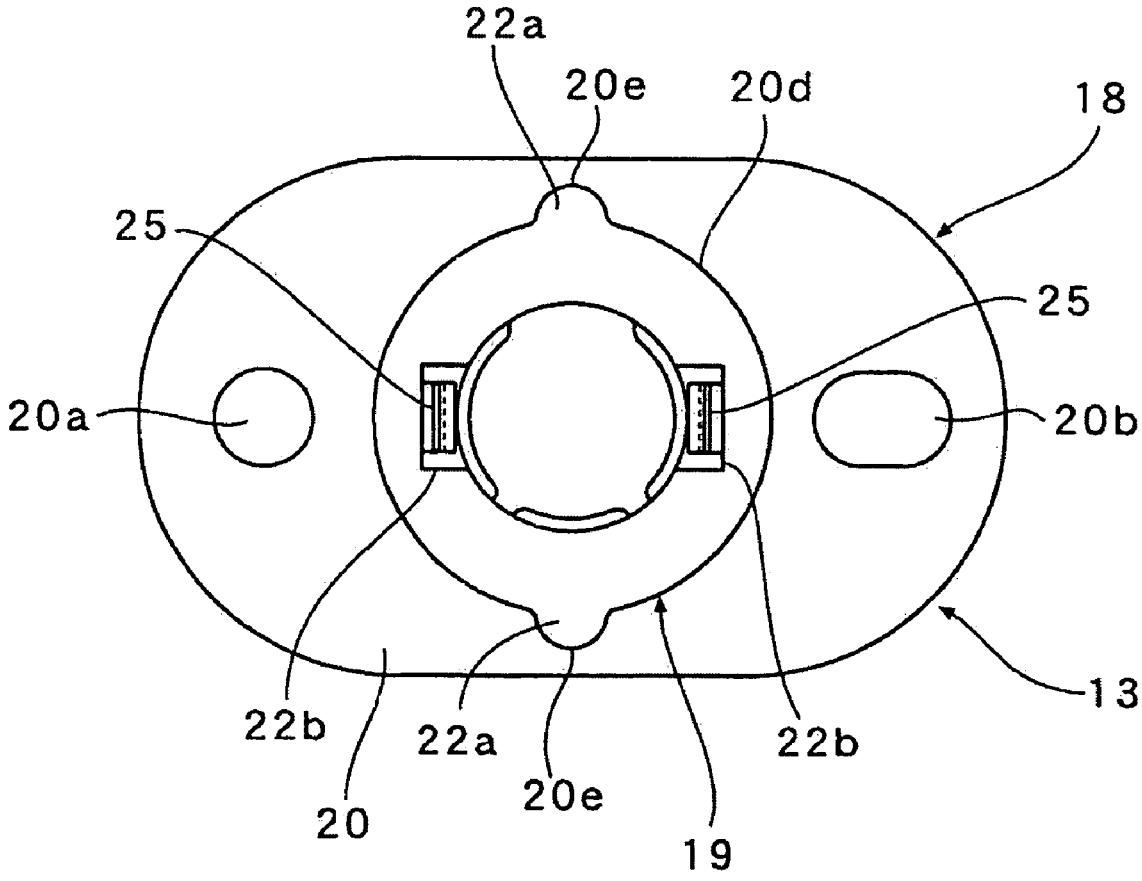
FIG. 6 is a bottom view showing a base member of the stay.

As shown in FIGS. 5A and 6, in the second base portion 19, semicircular protrusions 22*a* and 22*a* are formed on the external periphery so as to be located at symmetrical positions about the central axis of the flange portion 22. On the other hand, at the positions of the inner periphery of the recessed portion 20*d* of the first base portion 18 corresponding to the protrusions 22*a* and 22*a*, concave portions 20*e* and 20*e* for fining the protrusions 22*a* and 22*a* are formed. By mounting the flange portion 22 in the recessed portion 20*d* with the protrusions 22*a* and 22*a* fitted in the concave portions 20*e* and 20*e*, the second base portion 19 is positioned in the rotational direction and the rotational movement thereof is restricted (see FIG. 6).

On the external periphery of the hole 20*c* of the base portion main body 20 formed in the first base portion 18, a peripheral wall portion 23 is formed upwardly. The inner peripheral surface 23*a* of this peripheral wall portion 23 is narrowed at its upper portion. The narrowed portion has a curbed inner surface 23*b*, and the upper end of the peripheral wall portion 23 has an opening 23*c*. The inner upper surface of the opening 23*c* is formed into an inwardly inclined surface 23*d*. The peripheral wall portion 23 is divided by three slits 24 vertically extending from its upper end and dividing the inclined surface 23*d* at regular intervals. Thus, the peripheral wall portion 23 is divided into three divided wall pieces 23*e*, 23*e* and 23*e* via the slits 24, 24 and 24.

Figure 4:
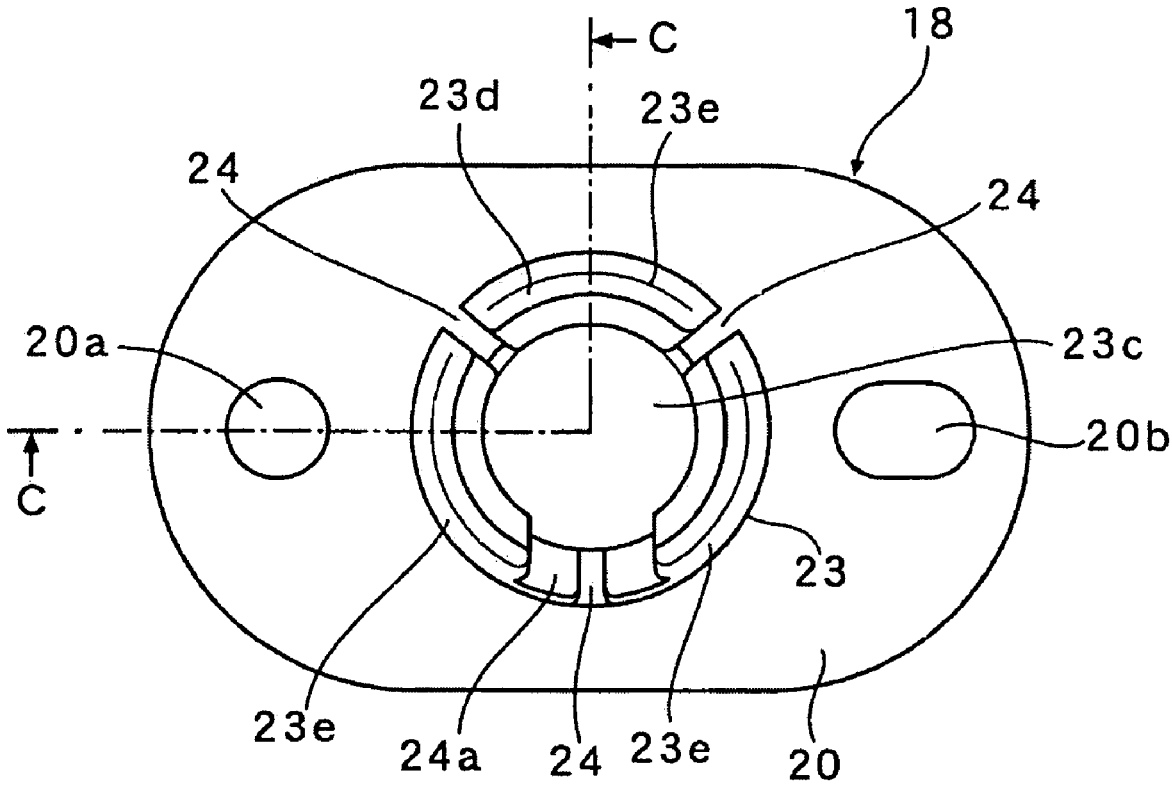
FIG. 4A is a plan view showing a first base portion of the stay.
FIG. 4B is a front view showing the first base portion of the stay.
FIG. 4C is a cross-sectional view taken along the line C-C in FIG. 4A.
Figure 4:
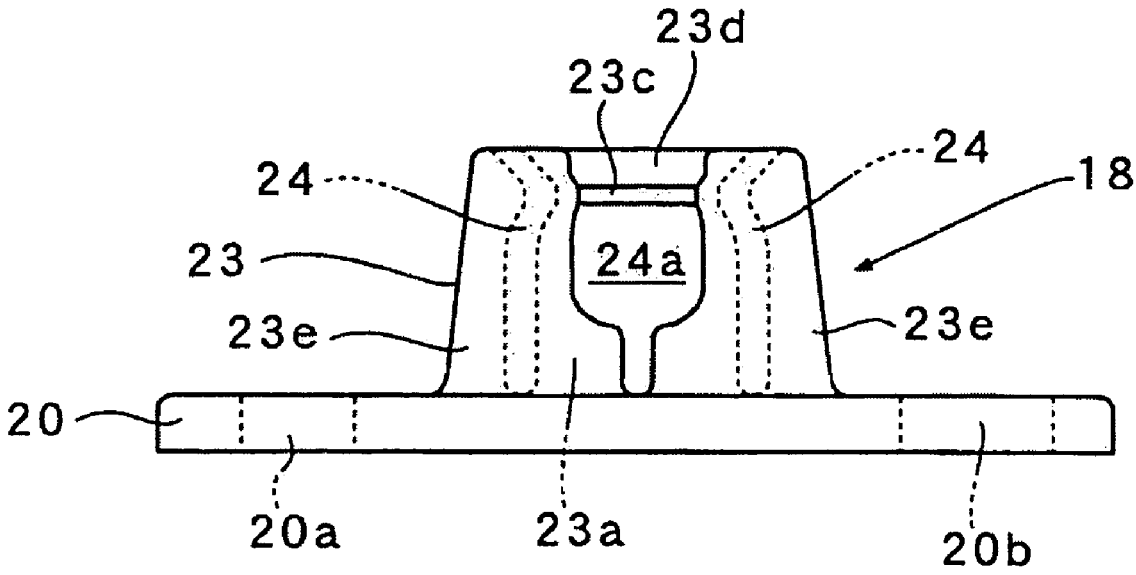
Figure 4:
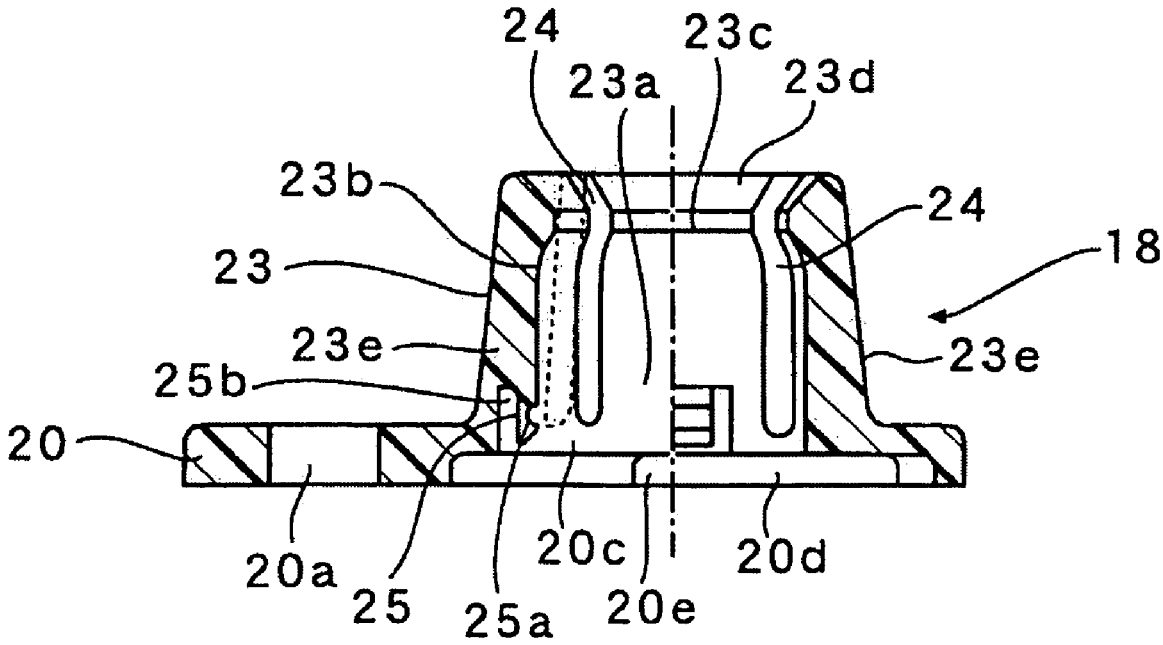

As shown in FIG. 4, one of the slits 24 is formed so as to extend in a direction approximately perpendicular to the straight line connecting the screw holes 20*a* and 20*b* formed in both ends of the base portion main body 20. In the slit 24, a recessed groove portion 24*a* capable of holding the external periphery of the stay main body 12 is formed. Also, a pair of opposing elastic engaging pieces 25 and 25 extend downward from the lower portion of the inner peripheral surface 23*a* of the peripheral wall portion 23 at the portions of the peripheral portion 23 on the line connecting the screw holes 20*a* and 20*b*. Each elastic engaging piece 25 is provided with a hook 25*a* at the lower opposed face. At the rear side of each elastic engaging piece 25, a gap 25*b* is provided so that the elastic engaging piece 25 can be elastically bent rearward. The lower end of the elastic engaging piece 25 is positioned slightly above the recessed portion 20*d*. On the other hand, as shown in FIG. 5, engaging portions 21*a* and 21*a* are formed at positions on the external periphery of the pedestal portion 21 of the second base portion 19 corresponding to the elastic engaging pieces 25 and 25. The upper surface of the pedestal portion 21 is formed into a recessed curved surface 21*b*.

When the flange portion 22 of the second base portion 19 is fitted in the recessed portion 20*d* of the first base portion 18, the pedestal portion 21 is fitted to the inner peripheral surface 23*a* of the peripheral wall 23 via the hole 20*c*, and the engaging portions 21*a* and 21*a* are engaged with the hooks 25*a* and 25*a* of the elastic engaging pieces 25 and 25 downwardly protruded from the inner peripheral surface 23*a*, whereby the second base portion 19 is fixed to the first base portion 18. At this time, a gap is formed between the lower end of the elastic engaging piece 25 and the upper surface of the flange portion 22. The flange portion 22 is provided with angular holes 22*b* and 22*b* at the positions corresponding to the engaging portions 21*a* and 21*a* so that a use can insert a tool from the rear side of the second base portion 19 through the angular hole 22*b* to release the engagement of the elastic engaging piece 25 to the engaging portion 21*a*.

In the space surrounded by the upper surface of the pedestal portion 21 of the second base portion 19 and the inner peripheral portion 23*a* of the peripheral wall portion 23 of the first base portion 18, a ball-like portion 16 integrally formed at the lower end of the stay main body 12 is disposed. This ball-like portion 16 is slidably disposed on the recessed curved surface 21*b* formed on the upper surface of the pedestal portion 21 and slidably held by the recessed curved surface 21*b* of the second base portion 19 and the curbed inner surface 23*b* formed at the upper portion of the inner peripheral surface 23*a* of the first base portion 18. The stay main body 12 extending from the ball-like portion 16 extends outward via the opening 23*c* formed on the upper portion of the peripheral wall portion 23.

On the other hand, the fastening member 14 is a resin molded article provided with a hooking portion 14*a* for holding the external periphery of the stay main body 12 and fixing holes 14*b* and 14*c*.

Assembly steps of the aforementioned stay 11 are explained below.

First, the top end side of the stay main body 12 is inserted into the inner hollow space of the peripheral wall portion 23 from the recessed portion 20*d* opened at the bottom surface of the first base portion 18 toward the inner peripheral surface 23*a* to thereby protrude the stay main body 12 through the opening 23*c* formed in the upper surface of the peripheral wall portion 23.

Then, the ball-like portion 16 integrally formed at the basal end of the stay main body 12 is brought into slide-contact with the curved inner surface 23*b* formed at the upper portion of the inner peripheral surface 23*a* of the peripheral wall portion 23.

Thereafter, the pedestal portion 21 of the second base portion 19 is approached the inner peripheral surface 23*a* of the peripheral wall portion 23 from the recessed portion 20*d* formed in the bottom surface of the first base portion 18. Then, the flange portion 22 formed at the lower portion of the second base portion 19 is fitted in the recessed portion 20*d* and the protrusions 22*a* and 22*a* formed at the symmetrical positions on the external periphery of the flange portion 22 are fitted in the corresponding concave portions 20*e* and 20*e* formed on the inner periphery of the recessed portion 20*d* (see FIG. 6). In this state, the second base portion 19 is positioned in the rotational direction and the movement thereof in the rotational direction is restricted.

When the flange portion 22 is fitted in the recessed portion 20*d*, the engaging portions 21*a* and 21*a* protrude from the external periphery of the pedestal portion 21 and engaged with the hooks 25*a* and 25*a* formed on the opposed surfaces of the pair of opposed elastic engaging pieces 25 and 25 downwardly protruding from the inner peripheral surface 23*a* of the peripheral wall potion 23 to be retained (see FIG. 3). In this state, the elastic engaging piece 25 is exposed to the angular hole 22*b* with the lower end positioned above the bottom surface of the flange portion 22, so that a gap is formed between the bottom surface of the flange portion 22 and the tip end of the elastic engaging piece 25. Accordingly, the elastic engaging piece 25 does not protrude from the bottom surface of the flange portion 22.

As a result, the ball-like portion 16 is swingably held by the recessed curved surface 21*b* formed on the upper surface of the pedestal portion 21 and the upper portion of the inner peripheral surface 23*a* of the peripheral wall portion 23.

In this embodiment, the base member 13 is constituted by two parts, i.e., the first base portion 18 and the second base portion 19, and the ball-like portion 16 is mounted from the bottom surface side of the first base portion 18 to be retained by the second base portion 19. Therefore, as compared with a conventional stay in which a ball-like portion is mounted from the side of the opening 23*c* formed in the upper surface of the peripheral wall portion 23, the assembly is improved and it is not required to provide a bent portion for allowing the insertion of the ball-like portion 16 by elastic deformation. The height of the base member 13 is there by lowered. Also, since no bent portion for allowing elastic deformation of the opening 23*c* is required, the strength of the opening 23*c* can be relatively enhanced.

Since the elastic engaging pieces 25 and 25 are provided on the line connecting the screw holes 20*a* and 20*a* but not at the side of the recessed groove portion 24*a* for holding the external periphery of the stay main body 12, the recessed groove portion 24*a* can be lowered, thereby further lowering the height of the base member 13.

Figure 7:
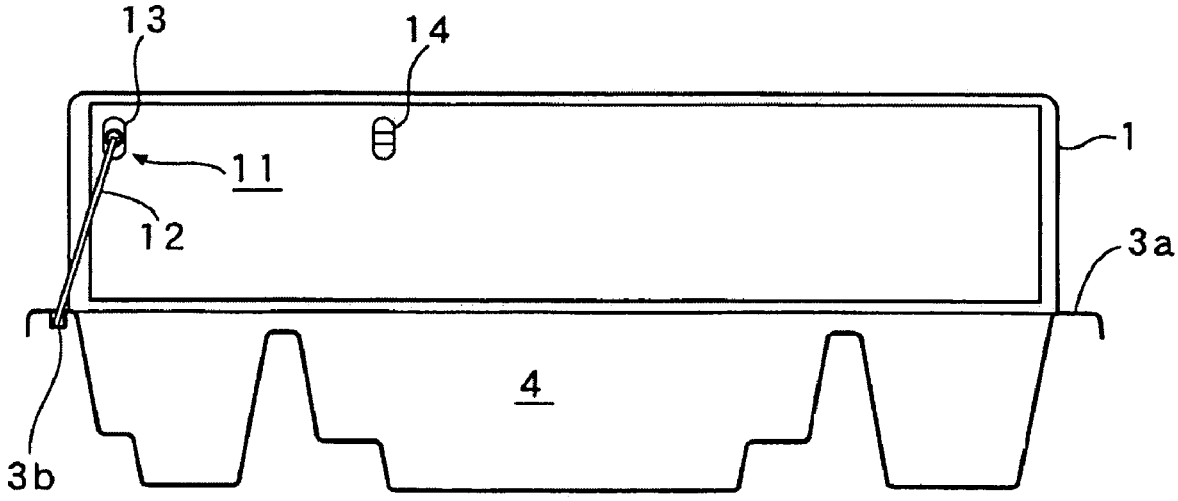
FIG. 7 is an explanatory view showing the state in which the stay is attached to an automobile cover board.

The base member 13 is then fixed to a predetermined position of the cover board 1 with screws via the screw holes 20*a* and 20*b* formed in the first base portion 18 of the base member 13. In cases where the mounting position of the base member 13 is located at the left side of the rear surface of the opening end of the cover board 1, as shown in FIGS. 7 and 8, and the stay main body 12 is positioned parallel to the edge portion of the opening side of the cover board 1 with the stay main body 12 accommodated in the recessed groove portion 24*a*, the screw holes 20*a* and 20*b* are arranged in the up-and-down direction with respect to the cover board 1.

Furthermore, the fastening member 14 for holding the top end side of the stay main body 12 is secured to the cover board 1 with screws via the fixing holes 14*b* and 14*c*.

FIG. 1 illustrates the state in which the stay main body 12 is stored along the rear surface of the cover board 1. In this stored state, the basal end side of the stay main body 12 is provided in the recessed groove portion 24*a* formed in the peripheral wall portion 23 of the first base portion 18 with the top end side held by the hook portion 14*a* of the fastening member 14.

Since the screw holes 20*a* and 20*b* formed in the first base portion 18 are arranged in a direction perpendicular to the extending direction of the fallen stay main body 12, i.e., the screw holes 20*a* and 20*b* are formed at positions not crossing the stay main body 12, even if screw heads are protruded from the screw holes 20*a* and 20*b*, the screw heads do not interfere with the stay main body 12. Therefore, the concave groove portion 24*a* can be formed relatively deep, which makes it possible to further lower the height of the base member 13. This in turn can reduce the mounting space required.

Since the storing space of the stay 11 can be small, the height protruding toward the storage box side can be minimized in the state in which the cover board 1 is closed. Accordingly, it is not specifically required to provide a space for accommodating the stay 11 at the side of the storage box 4 and the structure of the storage box 4 can be simplified. Since no space for accommodating the stay 11 is required at the side of the storage box 4, the fixing position of the stay 11 to the cover board 1 can be set relatively freely, thereby increasing the freedom of design.

After the fixing of the stay 11 to the predetermined position of the cover board 1 as mentioned above, the cover board 1 is attached to the opening portion of the storage box 4 formed in the luggage floor 3*a*.

In use, a user opens the cover board 1 closing the opening portion of the storage box 4 by pulling up the one end of the cover board 1 with the other end pivotally attached to the storage box 4. At this time, since the stay 11 is attached to the rear surface of the cover board 1, a user can easily recognize the stay 11 when the cover board 1 is opened, resulting in user-friendliness.

While maintaining the one end opened status of the cover board 1, the tip end portion of the stay main body 12 is detached from the hooking portion 14*a* of the fastening member 14. Then, the stay main body 12 is swung about the ball-like portion 16 formed at the basal end of the stay main body 12 and swingably held by the base member 13, and the Up end of the stay main body 12 is put in the engaging recessed portion 3*b* formed on the luggage floor 3*a* to thereby maintain the one end opened status of the cover board 1.

Since the stay main body 12 is swingably held by the base member 13 fixed to the cover board 1 via the ball-like portion 16 formed at the basal end of the stay main body 12, the engaging recessed portion 3*b* can be positioned at a relatively free position. Accordingly, as shown in FIGS. 7 and 8, the engaging recessed portion 3*b* can be provided at the luggage floor side. In this case, the space for the storage box 4 can be kept larger. Furthermore, since the engaging position can be arbitrarily set, even if the engaging position is different every type of vehicle, a single stay 1 can easily cope with all types of vehicles, resulting in improved versatility.

The maximum swingable angle of the stay main body 12 about the ball-like portion 16 supported by the base member 13 is defined by the contact position where the neck portion of the ball-like portion 16 comes into contact with the inclined surface 23*d* of the peripheral wall portion 23. Accordingly, an inclination of the stay main body 12 beyond the maximum swingable angle may cause a detachment of the ball-like portion 16 from the opening 23*c* formed in the upper surface of the peripheral wall portion 23 as the neck portion of the ball-like portion 16 acts as a fulcrum.

At this time, since the peripheral wall portion 23 is divided into three divided wall pieces 23*e*, 23*e* and 23*e* via the slits 24, 24 and 24, these divided wall pieces 23*e*, 23*e* and 23*e* will be elastically deformed outwardly to allow the detachment of the ball-like portion 16. As a result, the peripheral wall portion 23 is hardly deformed permanently or broken, thereby enabling reuse of the second base portion 19, which is economical.

The remounting of the stay main body 12 detached from the base member 13 can be performed by detaching the base member 13 from the cover board 1 and disengaging the hook 25*a* of the elastic engaging piece 25 from the engaging portion 21*a* by outwardly displacing the engaging piece 25 with a tool, etc., inserted in the angular hole 22*b* formed in the flange portion 22 of the second base portion 19 mounted to the bottom of the first base portion 18. Thereafter, after assembling in accordance with the aforementioned assembling steps, the base member 13 is fixed to the cover board 1.

As will be apparent from the above explanation, in this embodiment, even if the ball-like portion 16 is detached from the base member 13, the ball-like portion 16 can be reassembled by detaching the base member 13 from the cover board 1 and then assembling from the bottom surface side of the first base portion 18. Accordingly, it is not required to forcibly insert the ball-like portion 16 into the opening 23*c* with abnormal force as required in a conventional stay. Thus, the reassembling can be easily performed without causing permanent deformation or breakage of the peripheral wall portion 23. Furthermore, the base member 13 can be reused, which is economical. Even in the event of the permanent deformation or breakage of the peripheral wall portion 23, the second base portion 19 can be replaced with a new one, thereby reducing parts expenses.

It should be understood that the present invention is not limited to the above embodiment. For example, it can be configured such that the base portion main body 20 of the first base portion 18 and the flange portion 22 of the second base portion 19 are formed into the same configuration and that the flange portion 22 fits to the rear surface of the base portion main body 20 when the pedestal portion 21 of the second base portion 19 is fitted to the peripheral wall portion 23 of the first base portion 18. In this case, screw holes 20*a* and 20*b* are also formed in the flange portion 22 so that the base portion main body 20 of the first base portion 18 can be fixed to the cover board 1 together with the flange portion 22 of the second base portion 19 with screws.

While the present invention may be embodied in many different forms, a number of illustrative embodiments are described herein with the understanding that the present disclosure is to be considered as providing examples of the principles of the invention and such examples are not intended to limit the invention to preferred embodiments described herein and/or illustrated herein.

While illustrative embodiments of the invention have been described herein, the present invention is not limited to the various preferred embodiments described herein, but includes any and all embodiments having equivalent elements, modifications, omissions, combinations (e.g., of aspects across various embodiments), adaptations and/or alterations as would be appreciated by those in the art based on the present disclosure. The limitations in the claims are to be interpreted broadly based on the language employed in the claims and not limited to examples described in the present specification or during the prosecution of the application, which examples are to be construed as non-exclusive. For example, in the present disclosure, the term "preferably" is non-exclusive and means "preferably, but not limited to." In this disclosure and during the prosecution of this application, means-plus-function or step-plus-function limitations will only be employed where for a specific claim limitation all of the following conditions are present in that limitation: a) "means for" or "step for" is expressly recited; b) a corresponding function is expressly recited; and c) structure, material or acts that support that structure are not recited. In this disclosure and during the prosecution of this application, the terminology "present invention" or "invention" may be used as a reference to one or more aspect within the present disclosure. The language present invention or invention should not be improperly interpreted as an identification of criticality, should not be improperly interpreted as applying across all aspects or embodiments (i.e., it should be understood that the present invention has a number of aspects and embodiments), and should not be improperly interpreted as limiting the scope of the application or claims. In this disclosure and during the prosecution of this application, the terminology "embodiment" can be used to describe any aspect, feature, process or step, any combination thereof, and/or any portion thereof, etc. In some examples, various embodiments may include overlapping features. In this disclosure and during the prosecution of this case, the following abbreviated terminology may be employed: "e.g." which means "for example;" and "NB" which means "note well."

I claim:

1. A stay structure, comprising:

a stay main body having a ball portion at one end of the stay main body; and a base member configured to hold the ball portion, wherein the base member includes a first base portion and a second base portion detachably attached to the first base portion, wherein the first base portion is provided with a hole and a peripheral wall portion upwardly protruded from a periphery of the hole, the peripheral wall portion having an inner surface narrowed at an upper portion thereof, wherein the peripheral wall portion is divided by vertically extended slits into a plurality of divided wall pieces, at least one of the slits being provided with a dented groove portion capable of holding an external periphery of the stay main body, wherein the second base portion is provided with a flange portion in contact with a rear surface of the first base portion and a pedestal portion protruded toward the first base portion from the flange portion and fitted in the peripheral wall portion, wherein the pedestal portion has at its upper surface a curved surface on which the ball portion is swingably disposed, and wherein the ball portion is swingably held by the inner surface of the peripheral wall portion and the curved surface of the pedestal portion, wherein the first base portion is further provided with an elastic engaging piece downwardly extending from a lower portion of the inner surface of the peripheral wall portion so as not to protrude from the rear surface of the first base portion and a gap formed behind the elastic engaging piece, wherein the second base portion is provided with an engaging portion to be engaged with the elastic engaging piece, the engaging portion being formed on an external periphery of the pedestal portion, and wherein the flange portion of the second base portion is in contact with the rear surface of the first base portion and the engaging portion is engaged with the elastic engaging piece.

2. The stay structure as recited in claim 1, wherein the elastic engaging piece is formed at at least a position different from a position of the slit in which the dented groove portion is formed.

3. The stay structure as recited in claim 1, wherein a fastening hole is formed in at least one of the first base portion and the second base portion, and wherein the fastening hole is formed at a position where an extending direction of the stay main body held by the dented groove portion does not cross.

4. The stay structure as recited in claim 3, wherein the base member is fixed to a cover with a fastening member via the fastening hole.

5. The stay structure as recited in claim 1, wherein a pair of fastening holes are formed in the first base portion, and wherein the fastening holes are formed at positions on a linear line perpendicular to an extending direction of the stay main body held by the dented groove portion of the peripheral wall portion.

6. The stay structure as recited in claim 1, wherein the first base portion is further provided with another elastic engaging piece downwardly extending from a lower portion of the inner surface of the peripheral wall portion so as not to protrude from the rear surface of the first base portion and gap formed behind the elastic engaging piece, wherein the second base portion is provided with another engaging portion to be engaged with the another elastic engaging piece, the another engaging portion being formed on an external periphery of the pedestal portion, and wherein the flange portion of the second base portion is in contact with the rear surface of the first base portion and the engaging portions are engaged with the elastic engaging pieces.

7. The stay structure as recited in claim 6, wherein each of the elastic engaging pieces is formed at a position different from a position of the slit in which the dented groove portion is formed.

8. The stay structure as recited in claim 1, wherein the first base portion is provided with a dented portion formed on the rear surface thereof, and the flange portion of the second base portion is fitted in the dented portion.

9. The stay structure as recited in claim 1, wherein the engaging portion of the second base portion is a protrusion formed on an external periphery thereof, and the engaging piece of the first base portion is a concave portion formed on an internal periphery thereof, and wherein the flange portion of the second base portion is fitted in the dented portion of the first base portion with the protrusion engaged with the concave portion.

10. The stay structure as recited in claim 1, wherein the first base portion and the second base portion are made of resilient material.

11. A stay structure for maintaining an opened state of a cover for closing/opening an opening of a storage box formed in a floor of a vehicle, the stay structure comprising:

a stay main body having a ball portion at one end of the stay main body and a tip end portion;

a base member configured to swingably hold the ball-like portion; and a fastening portion configured to detachably holding the tip end portion of the stay main body, wherein the base member includes a first base portion and a second base portion detachably attached to the first base portion, wherein the first base portion is provided with a central hole, a peripheral wall portion upwardly protruded from a periphery of the central hole and a dented portion formed on a rear surface of the first base portion, the peripheral wall portion having an inner surface narrowed at an upper portion thereof, wherein the peripheral wall portion is divided by vertically extended slits into a plurality of divided wall pieces, one of the slits being provided with a dented groove portion capable of holding an external periphery of the stay main body, wherein the second base portion is provided with a flange portion fitted in the dented portion of the first base portion and a pedestal portion protruded toward the first base portion from the flange portion and fitted in the peripheral wall portion, wherein the pedestal portion has at its upper surface a curved surface on which the ball portion is swingably disposed, and wherein the ball portion is swingably held by the inner surface of the peripheral wall portion and the curved surface of the pedestal portion, wherein the first base portion is further provided with a pair of elastic engaging pieces each downwardly extending from a lower portion of the inner surface of the peripheral wall portion so as not to protrude from the rear surface of the first base portion and gaps each formed behind the elastic engaging piece, wherein the second base portion is provided with a pair of engaging portions to be engaged with the elastic engaging pieces, each engaging portion being formed on an external periphery of the pedestal portion, and wherein each of the engaging portions is engaged with the corresponding elastic engaging piece.

12. The stay structure as recited in claim 11, wherein a pair of fastening holes are formed in the first base portion, and wherein the fastening holes are formed at positions on a linear line perpendicular to an extending direction of the stay main body held by the dented groove portion of the peripheral wall portion.

13. The stay structure as recited in claim 11, wherein each of the elastic engaging pieces is formed at a position different from a position of the slit in which the dented groove portion is formed.

14. The stay structure as recited in claim 11, wherein the second base portion is provided with a protrusion formed on an external periphery thereof, and the first base portion is provided with a concave portion formed on an internal periphery thereof, and wherein the flange portion of the second base portion is fitted in the dented portion of the first base portion with the protrusion engaged with the concave portion.

15. The stay structure as recited in claim 11, wherein the first base portion and the second base portion are made of resilient material.

* * * * *